US011199035B2

(12) United States Patent
Williams

(10) Patent No.: US 11,199,035 B2
(45) Date of Patent: Dec. 14, 2021

(54) VERTICALLY ADJUSTABLE SASH LOCK

(71) Applicant: Howard L. Williams, Atlanta, GA (US)

(72) Inventor: Howard L. Williams, Atlanta, GA (US)

( * ) Notice: Subject to any disclaimer, the term of this patent is extended or adjusted under 35 U.S.C. 154(b) by 909 days.

(21) Appl. No.: 15/958,291

(22) Filed: Apr. 20, 2018

(65) Prior Publication Data

US 2019/0136595 A1 May 9, 2019

Related U.S. Application Data

(60) Provisional application No. 62/583,655, filed on Nov. 9, 2017.

(51) Int. Cl.

| | |
|---|---|
| ***E05C 21/00*** | (2006.01) |
| ***E05C 3/00*** | (2006.01) |
| ***E05C 3/04*** | (2006.01) |

(52) U.S. Cl.

CPC ..... *E05C 21/00* (2013.01); *E05C 3/004* (2013.01); *E05C 3/046* (2013.01)

(58) Field of Classification Search

CPC ..... E05B 15/0006; E05B 63/0056; E05B 65/0835; E05C 21/00; E05C 3/046; E05C 3/004; E05C 2007/007; E05C 7/005; E05C 3/043

See application file for complete search history.

(56) References Cited

U.S. PATENT DOCUMENTS

| | | | | |
|---|---|---|---|---|
| 7,063,361 | B1 | 6/2006 | Lawrence | |
| 8,567,830 | B2 * | 10/2013 | Liang | E05C 3/046 292/240 |
| 2008/0012358 | A1 * | 1/2008 | Liang | E05C 3/043 292/241 |

FOREIGN PATENT DOCUMENTS

| | | | |
|---|---|---|---|
| KR | 100406942 | 5/2001 | |
| KR | 20020087509 | * 11/2002 | E05C 3/046 |

OTHER PUBLICATIONS

Examination Report dated Jun. 5, 2019 for Great Britain Patent Application GB1807027.6.

Intention to Grant dated Apr. 28, 2020 for Great Britain Patent Application No. GB1807027.6.

Great Britain Patent Application GB1807027.6 filed on Apr. 30, 2018, Examination Report dated Oct. 23, 2018.

* cited by examiner

*Primary Examiner* — Kristina R Fulton
*Assistant Examiner* — Thomas L Neubauer
(74) *Attorney, Agent, or Firm* — Thomas | Horstemeyer, LLP

(57) ABSTRACT

A vertically adjustable sash lock is described that improves the seal of windows. The vertically adjustable sash lock may include, for example, a housing configured to be coupled to a first window sash and a rotatable cam configured to rotatably engage with a keeper bracket coupled to a second window sash. A vertical member may be positioned through a threaded aperture of the rotatable cam. A knob coupled to the vertical member may drive a rotation of the vertical member, causing a vertical position of the rotatable cam relative to a bottom surface of the housing to adjust accordingly.

17 Claims, 14 Drawing Sheets

*PRIOR ART*

VERTICALLY ADJUSTABLE SASH LOCK

CROSS-REFERENCE TO RELATED APPLICATION

This application claims the benefit of and priority to U.S. Provisional Patent Application No. 62/583,655, entitled "VERTICALLY ADJUSTABLE SASH LOCK," filed Nov. 9, 2017, the contents of which are incorporated by reference in their entirety herein.

BACKGROUND

Double-hung windows are those that feature an upper and lower sash that slide vertically past each other in a single window frame. Each sash consists of glass that is framed on the four sides by wood or other material. The horizontal sides of the frame are called rails. There is the upper rail and lower rail. The upper and lower sash move up and down allowing for ventilation on the top, bottom, or both top and bottom. Locking of a single-hung or double-hung window is commonly achieved usually by a special type of lock, referred to as a sash lock. For instance, sash locks are installed on window sashes to provide a locking mechanism that allows a home owner or other individual to lock a window in the closed position. Sash locks are important for home security and energy efficiency. Commonly, sash locks are configured to prevent vertical movement of window sashes, usually through a rotatable cam that engages and locks with a bracket, referred to as a keeper.

In double-hung windows, sash locks are designed to hold the upper and lower window sashes in a fixed closed position, with the lower rail of the upper sash aligning with an upper rail of the lower sash. It can only be locked in the closed position. However, many windows and window jambs, especially those in older homes, are made of wood, plastic, or other material having properties that change over time after being subjected to moisture, varying temperatures, and sunlight. Thus, the windows or their jambs loosen and shrink, and a tight seal with a window frame of a double-hung window is lost. Therefore, significant air leakage can occur. Air Leakage is defined as air leaking around window frames and sashes which allow heat or cold transfer as it moves in and out of homes or buildings. Moreover, when a portion of the window shrinks or warps, it impairs the ability of a traditional sash lock to align to securely lock the window. It also impairs the ability of the upper and lower sash to be completely closed when the sash lock is locked. Currently, sash locks only hold the upper sash and lower sash in a fixed closed position without the ability to adjust positions of the upper sash and the lower sash.

Some conventional sash locks, such as the WLS9 Window Sash Lock offered by Deltana®, include a rotatable circular-shaped cam having a slope, where the slope allows the circular cam to engage a keeper bracket when a first window sash and a second window sash aren't perfectly level. However, for the circular cam to engage the keeper bracket, the first window sash and the second window sash must be nearly level. Moreover, this type of sash lock only allows the top rail of the first window sash (lower sash) to become flush with the bottom rail of second window sash (upper sash). In this closed configuration, air leakage can occur.

BRIEF SUMMARY OF THE INVENTION

Various embodiments for a vertically adjustable sash lock are described that allow an individual to adjust an upper sash and a lower sash of a double-hung window vertically to create a better seal between a window sash and a window frame, especially for older windows. A vertically adjustable sash lock may include, for example, a housing configured to be coupled to a first window sash and a rotatable cam partially positioned within the housing configured to rotatably engage with a keeper bracket coupled to a second window sash. A vertical member may be positioned through an aperture of the rotatable cam. A knob coupled to the vertical member may drive a rotation of the vertical member, causing a vertical position of the rotatable cam relative to a bottom surface of the housing to adjust along a vertical axis. When coupled to the first and second window sash, the knob may be selectively turned to force a first window sash downwards and a second window sash upwards, thereby increasing a seal in a window.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure relates to vertically adjustable sash locks that, when engaged with a keeper bracket, allows an individual to adjust an upper sash and a lower sash of a double-hung window vertically to create a better seal between a window sash and a window frame. Conventional sash locks generally include a rotatable circular-shaped cam having a slope, where the slope allows the circular cam to engage a keeper bracket when a first window sash and a second window sash aren't perfectly level. However, for the circular cam to engage the keeper bracket, the first window sash and the second window sash must be nearly level. Moreover, this type of sash lock only allows the top rail of the first window sash to become flush with the bottom rail of the second window sash, which does not provide a sufficient degree of separation necessary to form a tight window seal. Sash locks have existed for over one-hundred years; however, there has been little to no innovation in how they function or operate and none of them provide a function which allows the sashes to be adjusted beyond the flushed position as will be described. As conventional sash locks, due to shrinkage, do not prevent air leakage, a long felt need exists for a sash lock capable of causing the window to form a seal, thereby increasing home security, preventing air leakage, and increasing energy efficiency.

According to various embodiments of the present disclosure, a vertically adjustable sash lock may include, for example, a housing configured to be coupled to a first window sash and a rotatable cam partially positioned within the housing configured to rotatably engage with a keeper bracket coupled to a second window sash. A vertical member may be positioned through an aperture of the rotatable cam. A knob coupled to the vertical member may drive a rotation of the vertical member, causing a vertical position of the rotatable cam relative to a bottom surface of the housing to adjust along a vertical axis. When coupled to the first and second window sashes, the knob may be selectively turned to force the first window sash downwards and the second window sash upwards, thereby increasing a seal in the window.

In the following discussion, a general description of a vertically adjustable sash lock and its components is provided, followed by a discussion of the operation of the same.

Figure 1:
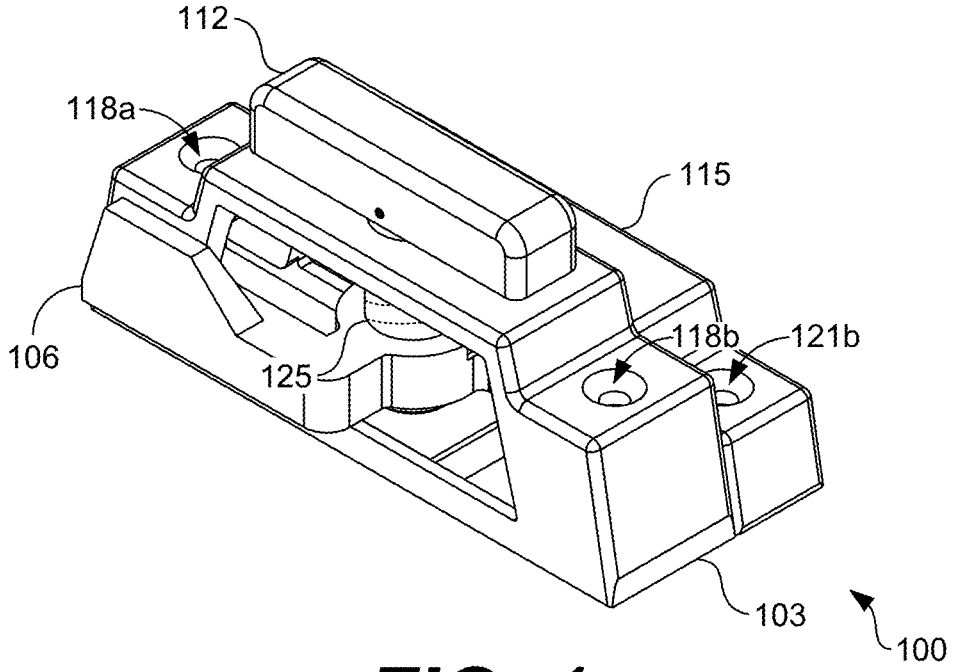
FIGS. 1 and 2 are front perspective views of a vertically adjustable sash lock according to various embodiments of the present disclosure.
Figure 2:
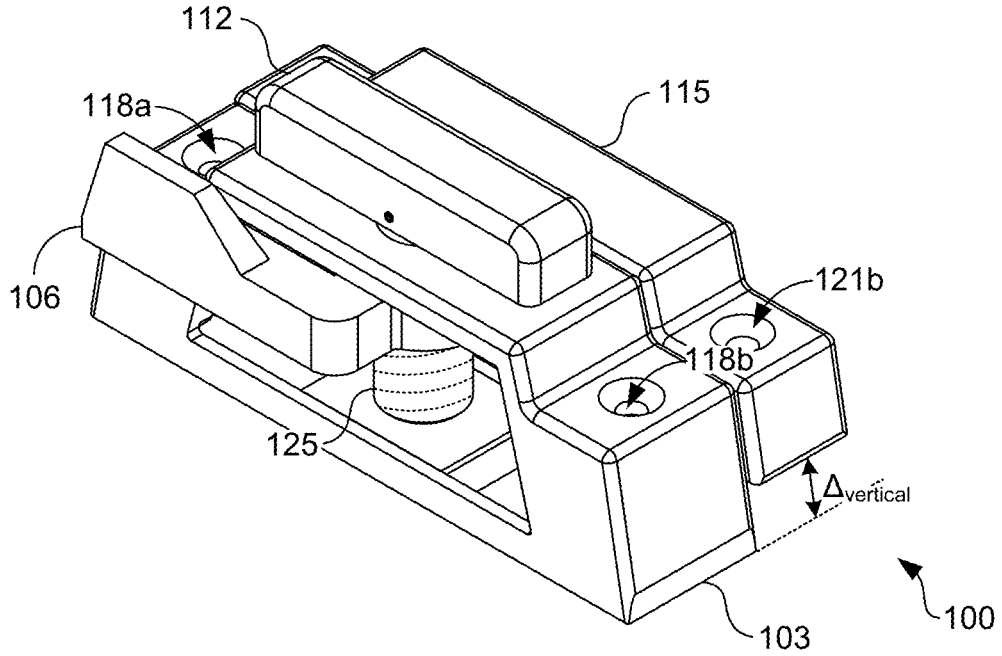
Figure 3:
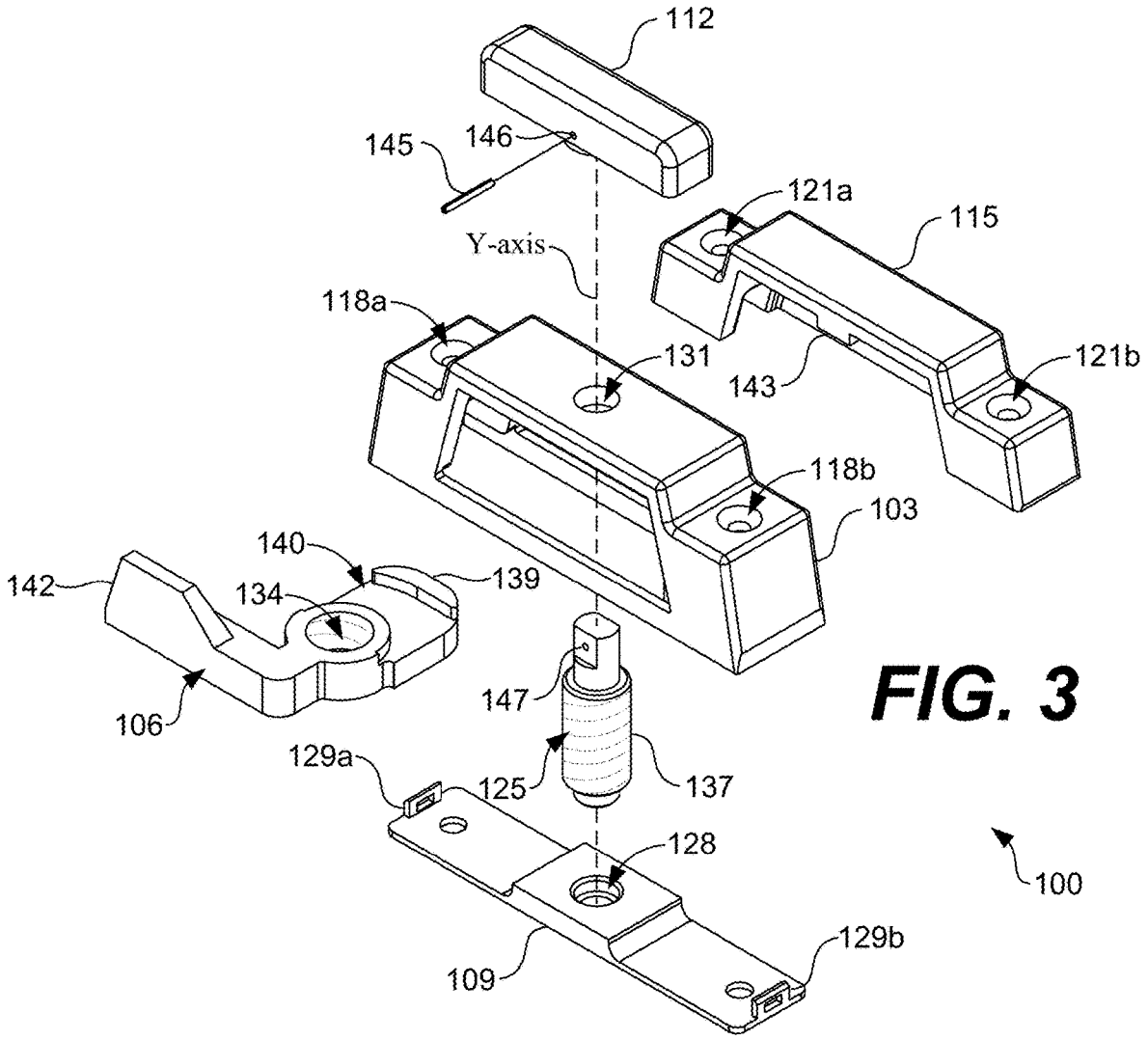
FIG. 3 is an exploded perspective view of the vertically adjustable sash lock according to various embodiments of the present disclosure.

In FIGS. 1 and 2, perspective views of a vertically adjustable sash lock 100 are shown while, in FIG. 3, an exploded perspective view of the vertically adjustable sash lock 100 is shown. In various embodiments, the vertically adjustable sash lock 100 may include, for example, a housing 103, a rotatable cam 106, a base plate 109, a knob 112, as well as other components as will be described. Additionally, a keeper bracket 115 is shown which may be described as being part of or separate from the vertically adjustable sash lock 100 in some embodiments. Notably, the housing 103 and the keeper bracket 115 are components that may be secured or coupled to respective sashes of a window.

For instance, the housing 103 of the vertically adjustable sash lock 100 may be configured to be secured to a rail of a first window sash (e.g., a top rail of a lower sash) and the keeper bracket 115 may be configured to be secured to a rail of a second window sash (e.g., a bottom rail of an upper sash), as will be illustrated and discussed. In some embodiments, the housing 103 may be secured to a first window sash by affixing one or more screws, nails, or similar coupling mechanisms to the first window sash via one or more coupling channels 118*a* . . . 118*b* (collectively "coupling channels 118"), which can be positioned on opposing, distal ends of the body of the housing 103. Similarly, the keeper bracket 115 may be secured to a second window sash by affixing one or more screws, nails, or similar coupling mechanisms to the second window sash via one or more coupling channels 121*a* . . . 121*b* (collectively "coupling channels 121"), which can be positioned on opposing, distal ends of the body of the keeper bracket 115. Each of the coupling channels 118, 121 may include concave or recessed upper portions that allow a screw or other coupling mechanism to become flush with a top surface of the housing 103 and keeper bracket 115.

Further, the vertically adjustable sash lock 100 may include a vertical member 125. In various embodiments, the vertical member 125 may include an elongated rod (such as a screw or a threaded shaft) that is configured to be at least partially disposed within a hollow interior of the housing 103. For instance, a first end (e.g., a bottom end) of the vertical member 125 may be positioned in a circular recess 128 of the base plate 109, while a second end of the vertical member 125 may be positioned through a top aperture 131 of the housing 103. When the second end of the vertical member 125 is positioned through the top aperture 131, the knob 112 may be coupled to the portion of the vertical member 125 protruding beyond a top surface of the housing 103. As such, a rotation of the knob 112 drives a rotation of the vertical member 125.

The rotatable cam 106 may be pivotably mounted to the vertical member 125, for instance, by positioning the vertical member 125 through an aperture 134 of the rotatable cam 106. To this end, in some embodiments, the vertical member 125 may include a threaded shaft 137 configured to threadably couple to the aperture 134 of the rotatable cam 106. For instance, when the knob 112 is turned, thereby driving a rotation of the vertical member 125, a vertical position of the rotatable cam 106 will adjust. In other words, the rotatable cam 106 will move upwards or downwards along the shaft of the vertical member 125. Notably, FIG. 1 shows the rotatable cam 106 at a first vertical position (e.g., closer to the bottom, inner surface of the housing 103) while FIG. 2 shows the rotatable cam 106 at a second vertical position (e.g., closer to the top, inner surface of the housing 103). Further, the base plate 109 is shown in FIG. 3 to include clips 129*a* . . . 129*b* that may be used to snap into or otherwise form an interference fit with receptacles and/or projections in an interior of the housing 103.

Figure 4:
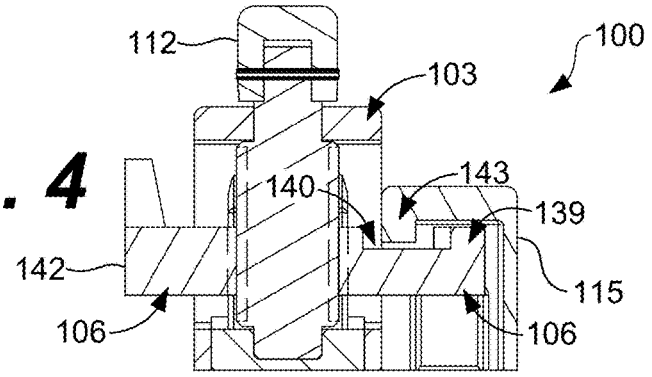
FIG. 4 is a side, cross-section view of the vertically adjustable sash lock according to various embodiments of the present disclosure.

The rotatable cam 106 may further include an upward projection 139, a channel 140, and a lever 142, as illustrated in FIG. 3. The keeper bracket 115 may include a downward projection 143 that may be used to couple the keeper bracket 115 to the rotatable cam 106. As may be appreciated, when the rotatable cam 106 is rotated concentric to the vertical member 125, for example, by manipulation of the lever 142, the channel 140 will receive the downward projection 143 of the keeper bracket 115. When the rotatable cam 106 is fully engaged with the keeper bracket 115, the upward projection 139 of the rotatable cam 106 will mate with the downward projection 143 of the keeper bracket 115, thereby securing the vertically adjustable sash lock 100 to the keeper bracket 115, as illustrated in the cross-section view of the vertically adjustable sash lock 100 shown in FIG. 4. Referring back to FIG. 1 and FIG. 2, the housing 103 is shown secured to the keeper bracket 115 via the rotatable cam 106, as may be appreciated. The cross-section view of FIG. 4 is consistent with the arrangement shown in FIG. 1.

When the knob 112 is positioned on the vertical member 125, a top distal end of the vertical member 125 can be inserted into a corresponding recess in the knob 112. The top distal end of the vertical member 125 and the corresponding recess in the knob 112 can be shaped to facilitate transmission of applied torque from the knob 112 to the vertical member 125. Referring again to FIG. 3, a pin 145 may be inserted into an aperture 146 of the knob 112 and an aperture 147 located at a top distal end of the vertical member 125 to further secure the knob 112 to the vertical member 125. In some embodiments, the pin 145 may include a stainless steel coiled spring pin or other suitable pin or fastener. The pin 145 may include a diameter substantially similar to a diameter of the aperture 146 of the knob 112 and the aperture 147 of the vertical member 125 such that the insertion of the pin 145 forms an interference fit to secure the knob 112 to the vertical member 125. However, other known coupling mechanisms may be employed.

Figure 5:
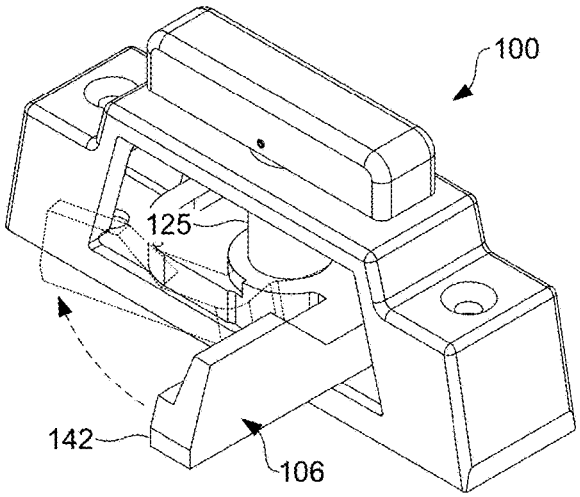
FIG. 5 is another perspective view of the vertically adjustable sash lock that illustrates a rotation of a lever according to various embodiments of the present disclosure.

Turning now to FIG. 5, another top perspective view of the vertically adjustable sash lock 100 is shown to illustrate the concentric movement of the rotatable cam 106 about the vertical member 125. In various embodiments, the rotatable cam 106 may include an L-shaped projection that extends radially from the vertical member 125. As noted above, the vertical member 125 may include a threaded shaft 137 configured to threadably couple to the aperture 134 of the rotatable cam 106. By virtue of the threaded coupling, the rotatable cam 106 is pivotably coupled to the vertical member 125 and, as such, the rotatable cam 106 may pivot around the vertical member 125, adjusting a position of the channel 140 and the upward projection 139 of the rotatable cam 106, such that the channel 140 and the upward projection 139 can engage with the downward projection 143 of the keeper bracket 115. In other words, by pushing or pulling the lever 142, the coupling between the rotatable cam 106 and the keeper bracket 115 may be engaged (e.g., "locked") or disengaged (e.g., "unlocked"), as may be appreciated. As the vertical position of the rotatable cam 106 may be adjusted by rotation of the knob 112, the rotatable cam 106 may engage with the keeper bracket 115 at a wide range of positions, making it easier to close, seal, and lock a window.

Figure 6A:
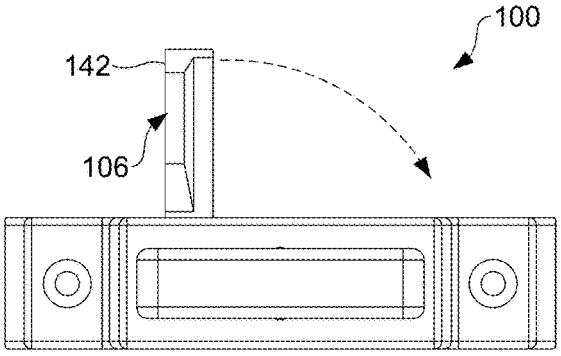
FIGS. 6A and 6B are top views of the vertically adjustable sash lock that further illustrate the rotation of the lever according to various embodiments of the present disclosure.
Figure 6B:
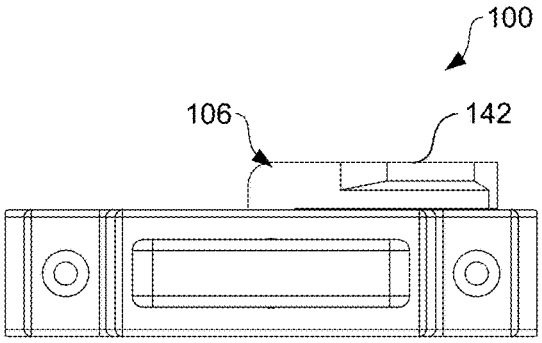
Figure 7:
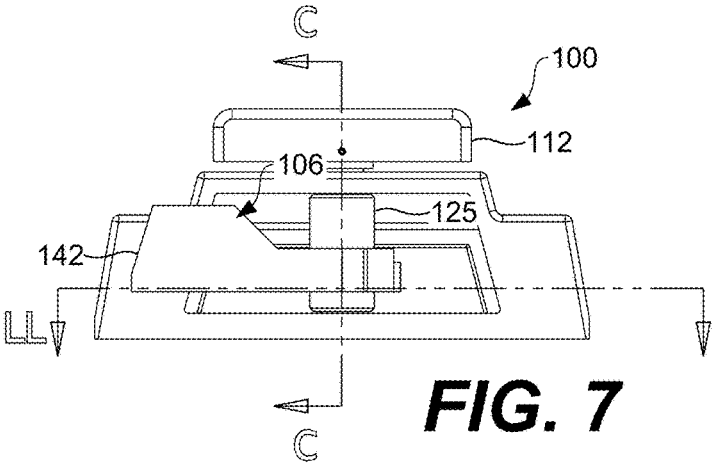
FIG. 7 is a front view of the vertically adjustable sash lock that illustrates the rotation of the lever and a rotation of a knob according to various embodiments of the present disclosure.

FIG. 6A and FIG. 6B include top views of the vertically adjustable sash lock 100 that further illustrate the rotation of the rotatable cam 106 and the lever 142. For instance, FIG. 6A shows the lever 142 in an unlocked state, whereas FIG. 6B shows the lever 142 in a locked state. The keeper bracket 115 is not shown for explanatory purposes. Similarly, FIG. 7 includes a front view of the vertically adjustable sash lock 100 that further illustrates the rotation of the rotatable cam 106, while also illustrating rotation of the knob 112 and the vertical member 125 driven by the knob 112.

Figure 8:
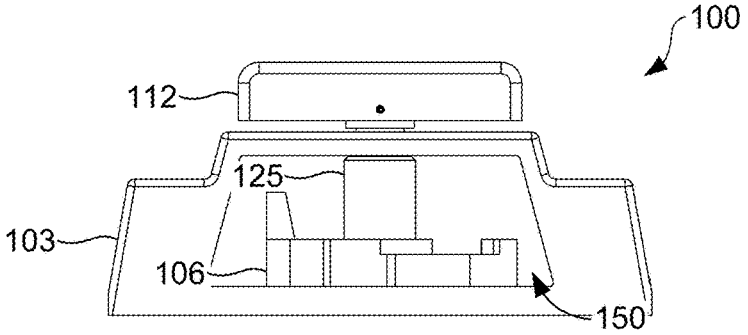
FIG. 8 is a rear view of the vertically adjustable sash lock according to various embodiments of the present disclosure.

Moving along to FIG. 8, a rear view of the vertically adjustable sash lock 100 (in a disengaged position) is shown that illustrates the vertical member 125 being at a central position in an interior of the housing 103. Further, in various embodiments, a front face and/or rear face of the vertically adjustable sash lock 100 may include an opening 150 that permits a rotation of the rotatable cam 106. To this end, in some embodiments, the opening 150 may be trapezoidal-shaped, rectangular-shaped, T-shaped, or other suitable shape. In embodiments in which the opening 150 is trapezoidal-shaped, the opening 150 may define a trapezoidal-shaped hollow interior of the housing 103. In embodiments in which the housing 103 is substantially symmetrical, both sides of the housing 103 may include a common-shaped opening 150.

Figure 9:
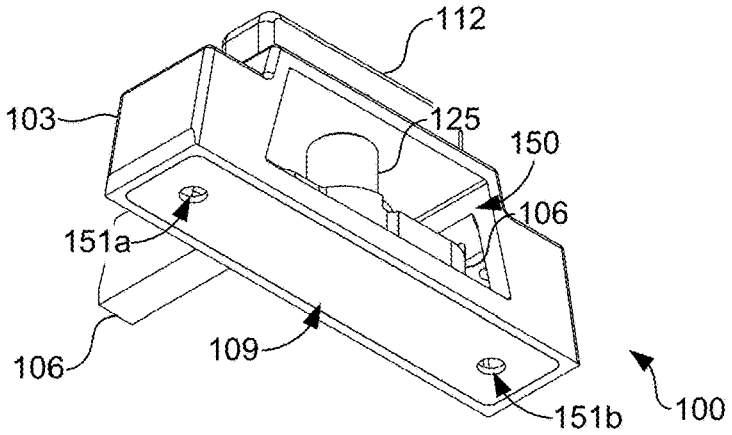
FIG. 9 is a bottom perspective view of the vertically adjustable sash lock that illustrates a base plate according to various embodiments of the present disclosure.

Referring now to FIG. 9, a bottom perspective view of the vertically adjustable sash lock 100 is shown that better illustrates the base plate 109. In various embodiments, the housing 103 may include an opening that is substantially similar to a shape of the base plate 109 such that the base plate 109 can be nested in the housing 103. However, when nested, a bottom surface of the base plate 109 may be flush with a bottom surface of the housing 103. The base plate 109 may further include base plate apertures 151 (e.g., 151*a* and 151*b*) that align with the coupling channels 118 in the housing 103 to allow screws, nails, or similar coupling mechanisms to pass through for mounting of the base plate 109.

Figure 10:
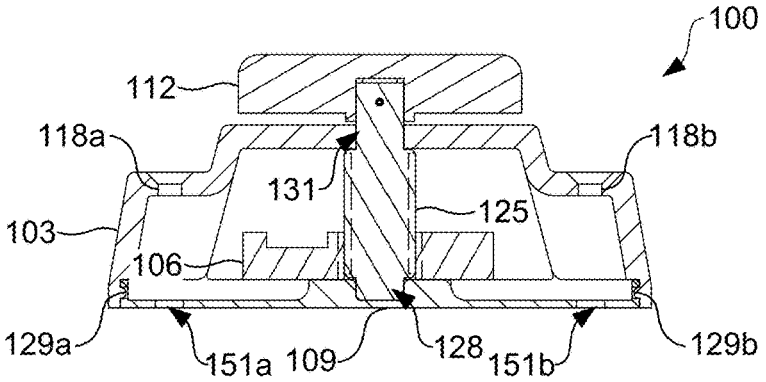
FIG. 10 is a front, cross-section view of the vertically adjustable sash lock that illustrates a receipt of a vertical member in a recess of the base plate according to various embodiments of the present disclosure.

Referring next to FIG. 10, a cross-section view of the vertically adjustable sash lock 100 further illustrates the circular recess 128 of the base plate 109. As noted above, the first end (e.g., the bottom end) of the vertical member 125 may be positioned in the circular recess 128 of the base plate 109, while the second end (e.g., the top end) of the vertical member 125 may be positioned through a top aperture 131 of the housing 103. In some embodiments, a bushing (not shown) may be positioned in the circular recess 128, where the bushing includes an aperture configured to receive the bottom end of the vertical member 125. The bushing may reduce friction in the circular recess 128 and more suitably allow for the rotation of a non-threaded portion of the vertical member 125.

Figure 11A:
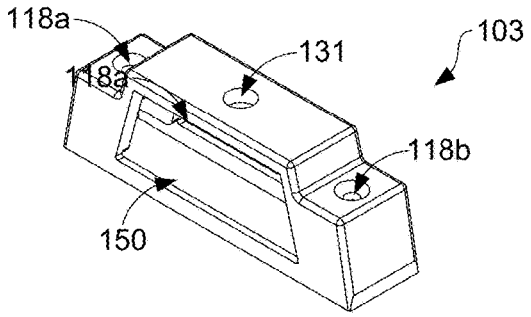
FIGS. 11A and 11B are perspective views of a housing of the vertically adjustable sash lock according to various embodiments of the present disclosure.
Figure 11B:
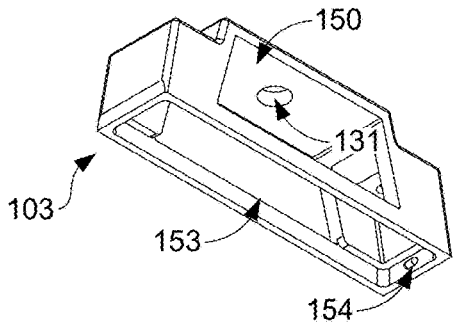

Additional perspective views of the housing 103 are shown in FIG. 11A and FIG. 11B. Notably, a bottom opening 153 is shown in which in the base plate 109 may be nested or otherwise received. As shown in FIG. 11B, the bottom opening 153 may be trapezoidal-shaped to receive a trapezoidal-shaped base plate 109, although openings of other shapes may be employed. In some embodiments, the bottom opening 153 has a size substantially similar to a size of the base plate 109, as illustrated in FIG. 9. The clips 129*a* . . . 129*b* of the base plate 109, as illustrated in FIG. 3, may engage with one or more projections 154 to lock the base plate 109 into the position shown in FIG. 9. The cross-section view of FIG. 10 illustrates the engagement of the clips 129 with projections 154, better shown in FIG. 11B.

Figure 12A:
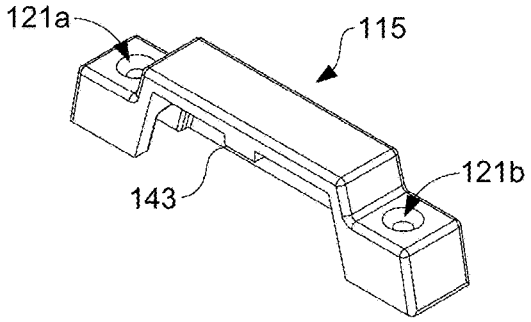
FIGS. 12A and 12B are perspective views of a keeper bracket of the vertically adjustable sash lock according to various embodiments of the present disclosure.
Figure 12B:
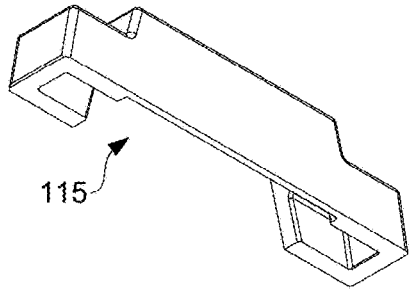

Turning now to FIG. 12A and FIG. 12B, additional perspective views of the keeper bracket 115 are shown. The keeper bracket 115 may be secured to a second window sash by affixing one or more screws, nails, or similar coupling mechanisms (not shown) to the second window sash via the coupling channels 121*a* . . . 121*b* that may be positioned on opposing, distal ends of the body of the keeper bracket 115. The keeper bracket 115 may further include a downward projection 143 that is used to couple the keeper bracket 115 to the rotatable cam 106. As may be appreciated, when the rotatable cam 106 is rotated concentric to the vertical member 125, for example, by manipulation of the lever 142, the channel 140 will receive the downward projection 143 of the keeper bracket 115. When the rotatable cam 106 is fully engaged with the keeper bracket 115, the upward projection 139 of the rotatable cam 106 will mate with the downward projection 143 of the keeper bracket 115, thereby securing the vertically adjustable sash lock 100 to the keeper bracket 115, as illustrated in the cross-section view of the vertically adjustable sash lock 100 shown in FIG. 4. The keeper bracket 115 may include a tiered body, similar to the housing 103, as may be apparent from FIGS. 11A, 11B, 12A, and 12B.

Figure 13A:
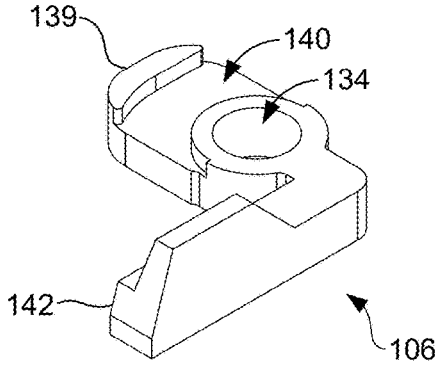
FIGS. 13A and 13B are perspective views of a rotatable cam of the vertically adjustable sash lock according to various embodiments of the present disclosure.
Figure 13B:
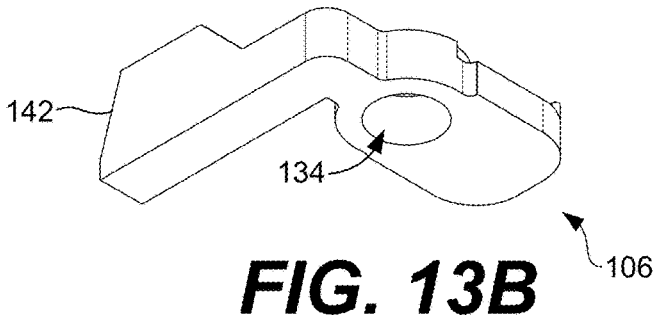

Moving on to FIG. 13A and FIG. 13B, additional perspective views of the rotatable cam 106 are shown. As noted above, the rotatable cam 106 may include an aperture 134 in which the vertical member 125, or a portion thereof, may be received. The vertical member 125 and the aperture 134 of the rotatable cam 106 may form a threaded connection, permitting the rotatable cam 106 to rotate about the vertical member 125 to adjust a position of the rotatable cam 106 along a vertical axis (e.g., the Y-axis shown in FIG. 3). The aperture 134 may be positioned in a central portion of the body of the rotatable cam 106 in some embodiments, for instance, between a channel 140 and the lever 142. The lever 142 may include, for example, an L-shaped projection.

In some embodiments, the vertical member 125 may include a threaded shaft 137 configured to threadably couple to the aperture 134 of the rotatable cam 106. For instance, when the knob 112 is turned, thereby driving a rotation of the vertical member 125, a vertical position of the rotatable cam 106 will adjust or, in other words, the rotatable cam 106 will move upwards or downwards along the shaft of the vertical member 125. Referring back to FIG. 1, the rotatable cam 106 is shown at a first vertical position (e.g., closer to the bottom, inner surface of the housing 103) while FIG. 2 shows the rotatable cam 106 at a second vertical position (e.g., closer to the top, inner surface of the housing 103).

Referring again to FIG. 13A and FIG. 13, the rotatable cam 106 may include an upward projection 139 positioned at a distal end of the channel 140. When the rotatable cam 106 is rotated about the vertical member 125, for example, by manipulation of the lever 142, the channel 140 may receive the downward projection 143 of the keeper bracket 115 when the keeper bracket 115 is suitably positioned. When the rotatable cam 106 is fully engaged with the keeper bracket 115 (e.g., in a fully locked position), the upward projection 139 of the rotatable cam 106 will mate with the downward projection 143 of the keeper bracket 115, thereby securing the vertically adjustable sash lock 100 to the keeper bracket 115.

Figure 14A:
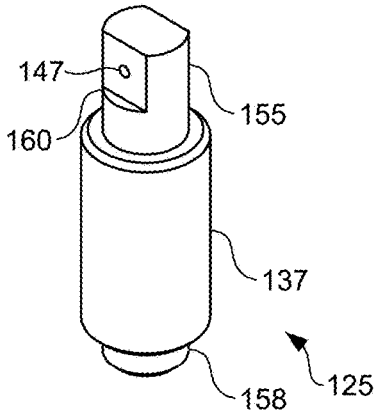
FIGS. 14A-14C are perspective views of the vertical member of the vertically adjustable sash lock according to various embodiments of the present disclosure.
Figure 14B:
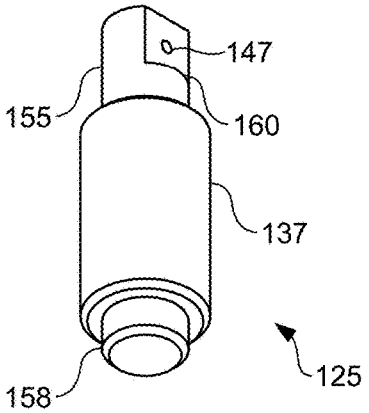
Figure 14C:
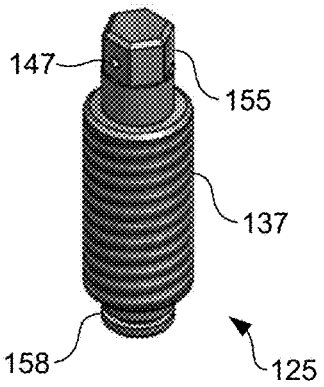
Figure 14D:
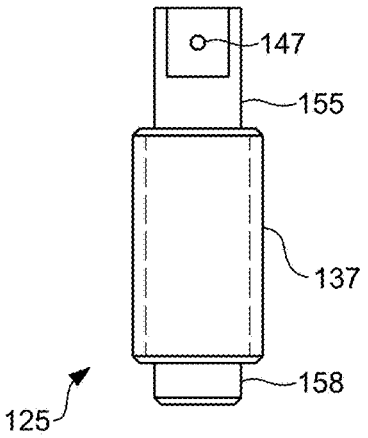
FIGS. 14D and 14E are side views of the vertical member of the vertically adjustable sash lock according to various embodiments of the present disclosure.
Figure 14E:
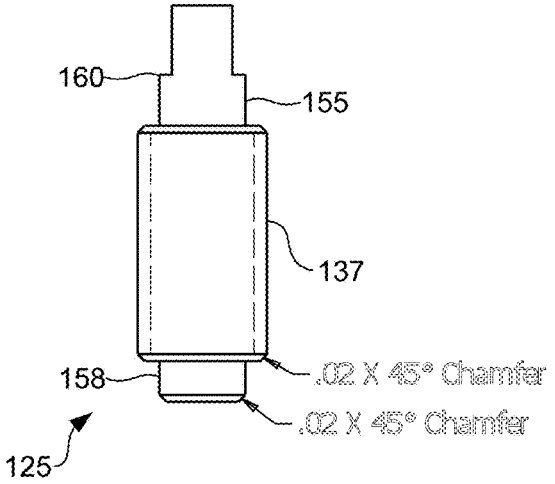
Figure 14F:
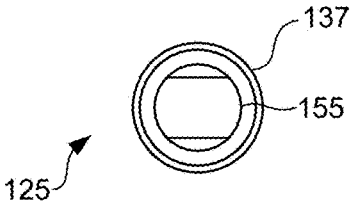
FIGS. 14F and 14G are top and bottom views, respectively, of the vertical member of the vertically adjustable sash lock according to various embodiments of the present disclosure.
Figure 14G:
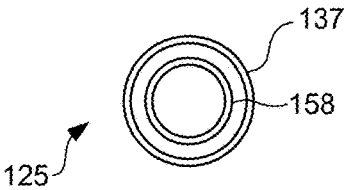

Moving on to FIGS. 14A-14F, additional views of the vertical member 125 are shown according to various embodiments. Specifically, FIGS. 14A-14C include perspective views of embodiments of the vertical member 125, FIGS. 14D-14E illustrate side views of the vertical member 125, and FIGS. 14F-14G illustrate top and bottom views of the vertical member 125, respectively. The vertical member 125 may include a threaded shaft 137 in a central portion of the body of the vertical member 125. For explanatory purposes, the threads of the threaded shaft 137 are not shown in FIGS. 14A, 14B, 14D, and 14E. However, the threads of the threaded shaft 137 are illustrated in FIG. 14C. The threaded shaft 137, as the central portion, may radially project beyond a top portion 155 and a bottom portion 158 of the vertical member 125. In other words, the threaded shaft 137 may have a diameter greater than a diameter of the top portion 155 and a diameter of the bottom portion 158.

The top portion 155 of the vertical member 125 may be configured to at least partially protrude beyond the top aperture 131 in the housing 103 when the vertical member 125 is installed in the housing 103. As such, the top portion 155 may include a shape that facilitates a coupling with the knob 112. As shown in FIGS. 14A and 14B, the shape of the top portion 155 may by substantially circular, while including flat sides and a ridge (or shoulder) 160 that interferes with a bottom of the knob 112. FIG. 14C alternatively shows a top portion 155 having an octagonal shape and cross-section. Other geometric shapes may also be utilized.

The top portion 155 may include an aperture 147 located at a top distal end of the vertical member 125 that intersects or aligns with an aperture 146 of the knob 112 such that a pin 145 may be employed to secure the knob 112 to the top portion 155. In some embodiments, the aperture 147 may have a diameter substantially similar to a diameter of a pin 145. As such, an insertion of the pin 145 into the aperture 146 of the knob 112 and the aperture 147 of the vertical member forms an interference fit that secures the knob 112 to the vertical member 125.

The bottom portion 158, like the top portion 155, may also be non-threaded and include a diameter less than a diameter of the threaded shaft 137. The bottom portion 158 may be sized and positioned to fit in the circular recess 128 of the base plate 109 and/or a bushing positioned in the circular recess 128, while permitting a rotation of the vertical member 125 in the circular recess 128. In some embodiments, the bottom and/or top of the threaded shaft 137, as well as the bottom and/or top of the bottom portion 158, may include a 45° chamfer.

Figure 15A:
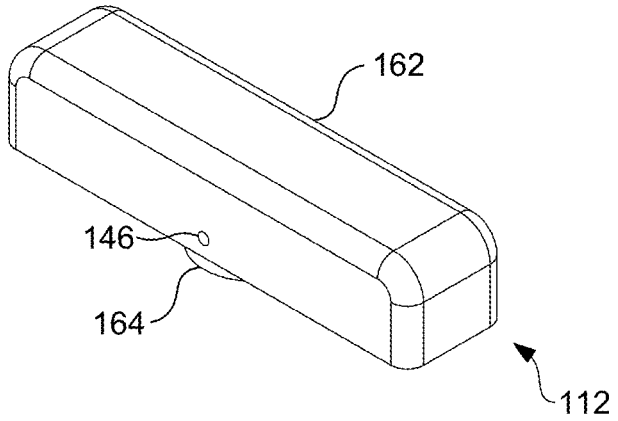
FIGS. 15A and 15B are top and bottom perspective views, respectively, of the knob of the vertically adjustable sash lock according to various embodiments of the present disclosure.
Figure 15B:
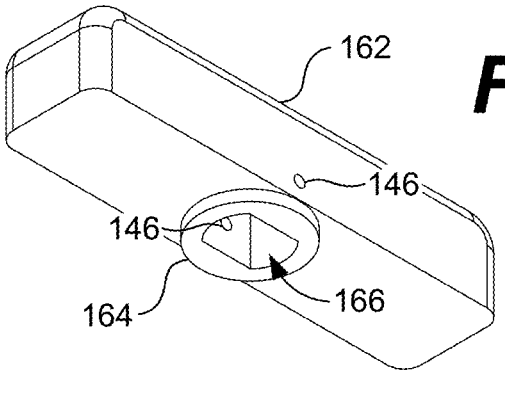
Figure 15C:
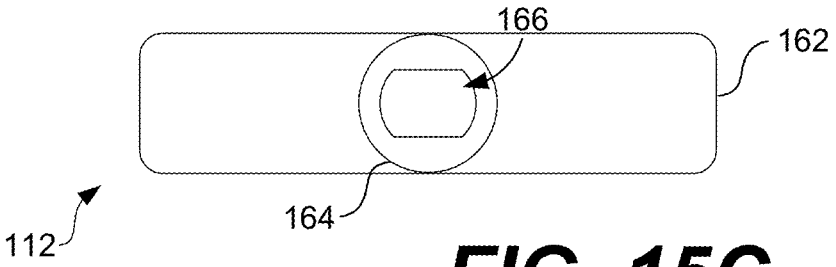
FIG. 15C is a bottom view of the knob of the vertically adjustable sash lock according to various embodiments of the present disclosure.

Referring next to FIGS. 15A-15C, additional views of the knob 112 are shown which may be positioned on a top outside surface of the housing 103. In various embodiments, the knob 112 includes a knob body 162 that facilitates turning by hand (e.g., the hand of an individual) or turning using a tool, such as a wrench. For instance, a rotation of the knob in a first direction (e.g., clockwise) may cause a vertical position of the rotatable cam 106 to increase relative to the bottom surface of the housing 103. Similarly, the rotation of the knob in a second direction (e.g., counter-clockwise) may cause the vertical position of the rotatable cam 106 to decrease relative to the bottom surface of the housing 103. A knob base 164 may protrude from a bottom of the knob body 162 in some embodiments. The knob base 164 may include an opening 166 sized and positioned (e.g., circular with flat sides) to receive the top portion 155 of the vertical member 125 such that an interference fit is formed with the top portion 155 of the vertical member 125.

A bottom view of the knob 112, shown in FIG. 15C, illustrates the shape of the opening 166. Other geometric shapes that match the top portion 155 of the vertical member 155 (e.g., an octagon) can be utilized. Additionally, the knob 112 may include an aperture 146 configured to align with an aperture 147 in the top portion 155 of the vertical member 125, for instance, when the knob 112 is positioned on the vertical member 125. As such, the pin 145 may be inserted through both apertures 146, 147 to further secure the knob 112 to the vertical member 125. It is understood that the knob base 164 may rest on the ridge 160 (or shoulder) defined in the top portion 155 of the vertical member 125 when at least a part of the top portion 155 of the vertical member 125 is positioned in the opening 166. The depth of the opening 166 and/or the ridge 160 may prevent the vertical member 125 from extending too far into the opening 166 of the knob 112.

Figure 16:
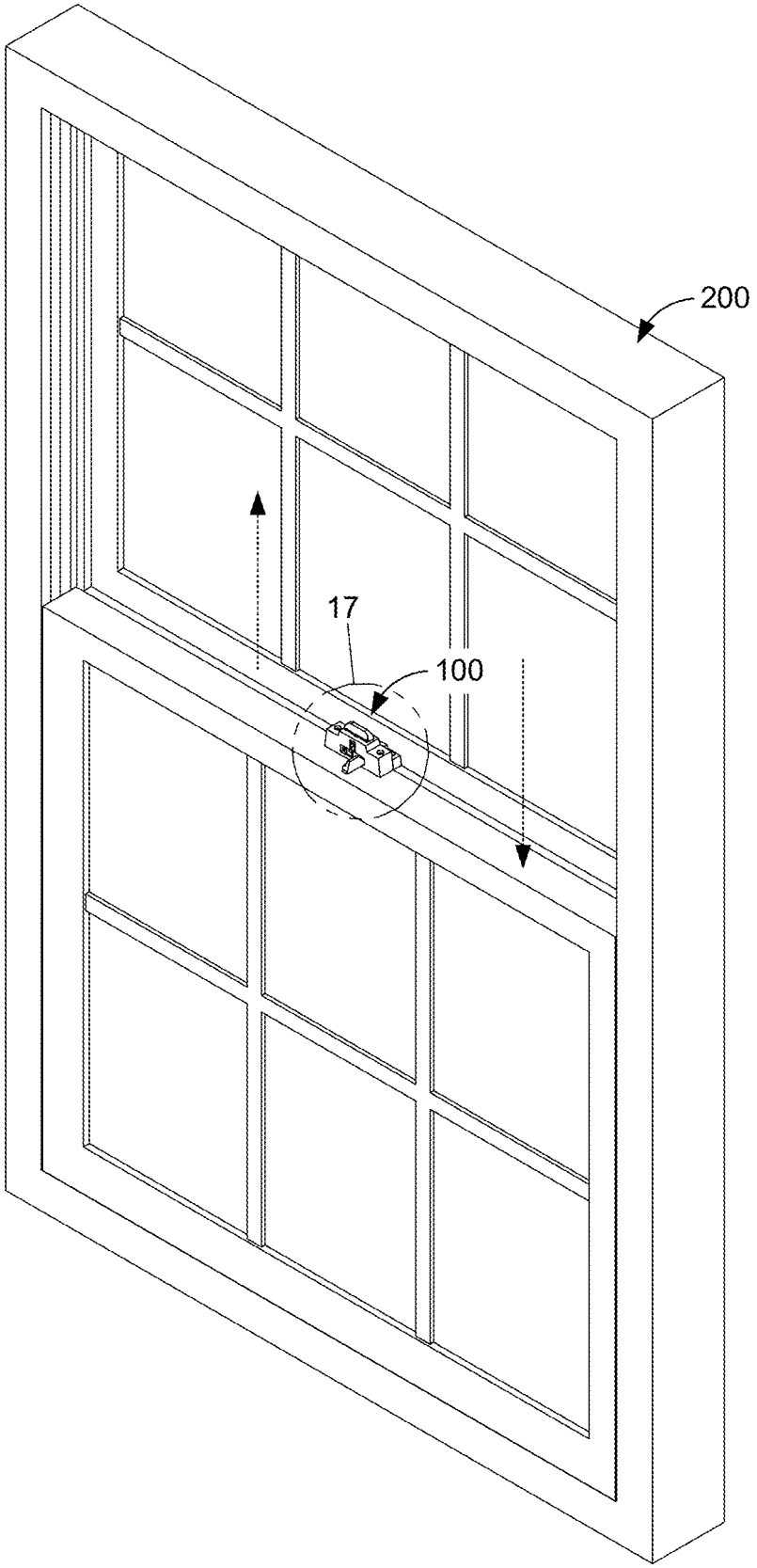
FIG. 16 is a perspective view of the vertically adjustable sash lock installed on a window according to various embodiments of the present disclosure.
Figure 17:
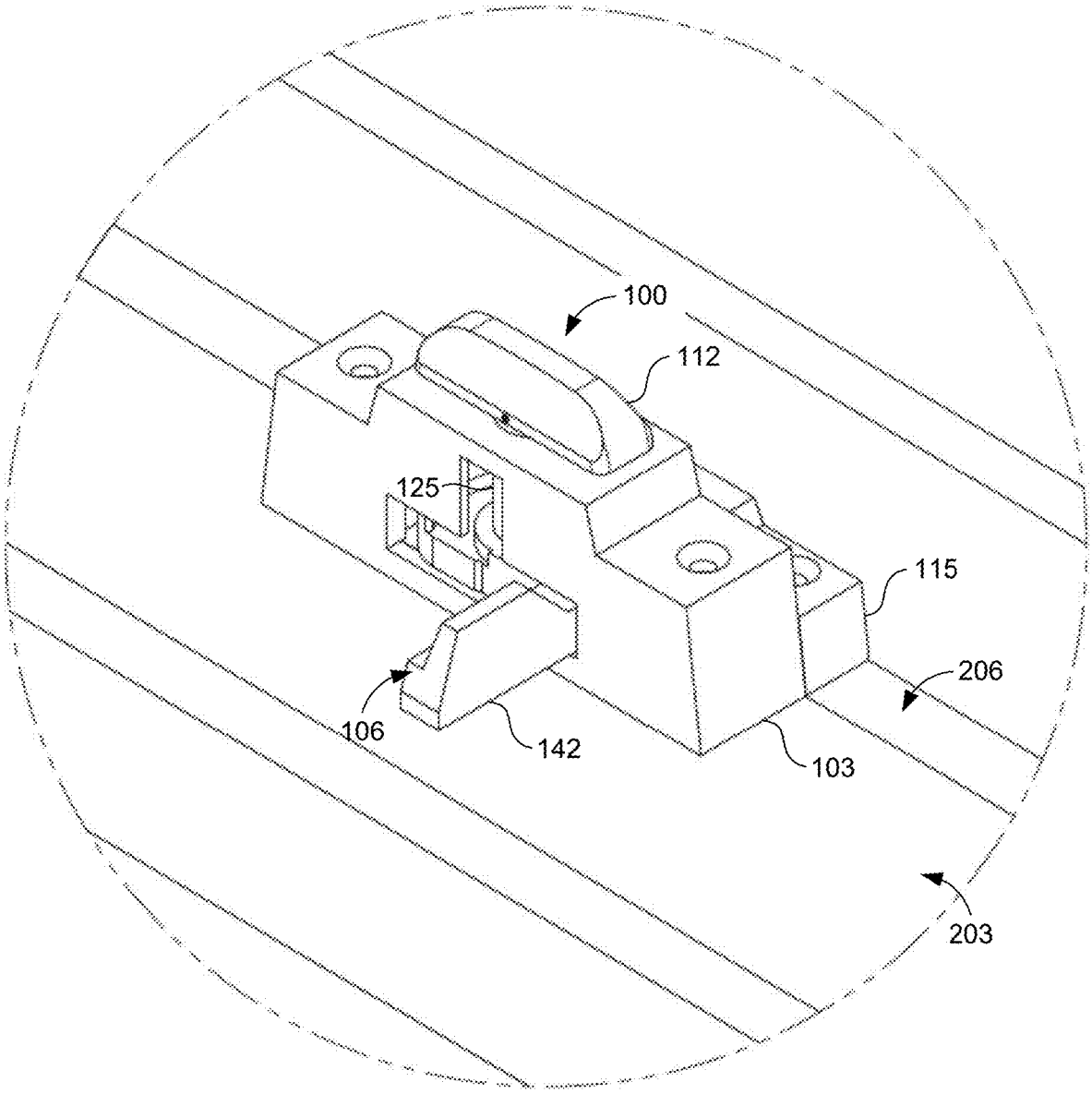
FIG. 17 is an enlarged perspective view of the vertically adjustable sash lock of FIG. 16 installed on a window according to various embodiments of the present disclosure.

Turning now to FIGS. 16 and 17, an embodiment of the vertically adjustable sash lock 100 is shown installed on a window 200. While shown as a double-hung window, it is understood that other types of windows 200 may be employed. An enlarged view of callout region 17 is shown in FIG. 17. For instance, as illustrated in FIG. 17, the housing 103 may be secured to a top rail of a lower sash 203 of the window 200 and the keeper bracket 115 may secured to a bottom rail of an upper sash 206 of the window 200.

To account for shrinking, warping, or other vertical displacement between the top rail of the lower sash 203 and the bottom rail of the upper sash 206 of the window 200, an operator may selectively rotate the knob 112 clockwise or counter-clockwise, as may be appreciated. As the rotation of the knob 112 drives the rotation of the vertical member 125, the position of the rotatable cam 106 will adjust vertically (e.g., move upwards or downwards), depending on the direction of rotation of the knob 112. As such, when the rotatable cam 106 is coupled to the keeper bracket 115, a clockwise rotation of the knob 112 may cause an upward force to be applied against an upper window sash and a downward force to be applied against a lower window sash. In other words, the vertically adjustable sash lock 100 causes vertical forces to be applied in opposing directions. The vertically adjustable sash lock 100 may function as a traditional sash lock, securing the first window sash to a second window sash.

Figure 18:
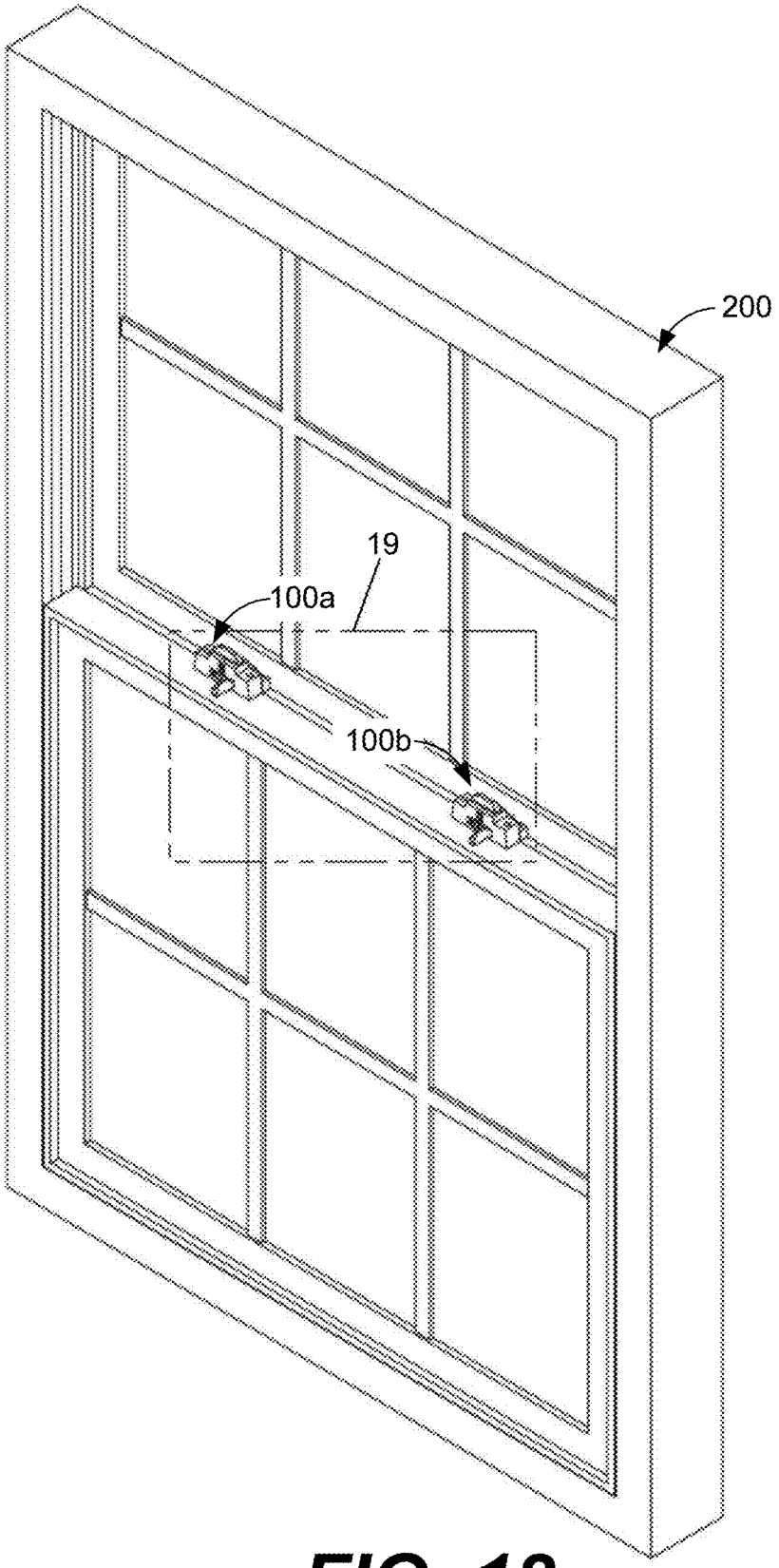
FIG. 18 is a perspective view of multiple vertically adjustable sash locks installed on a window according to various embodiments of the present disclosure.
Figure 19:
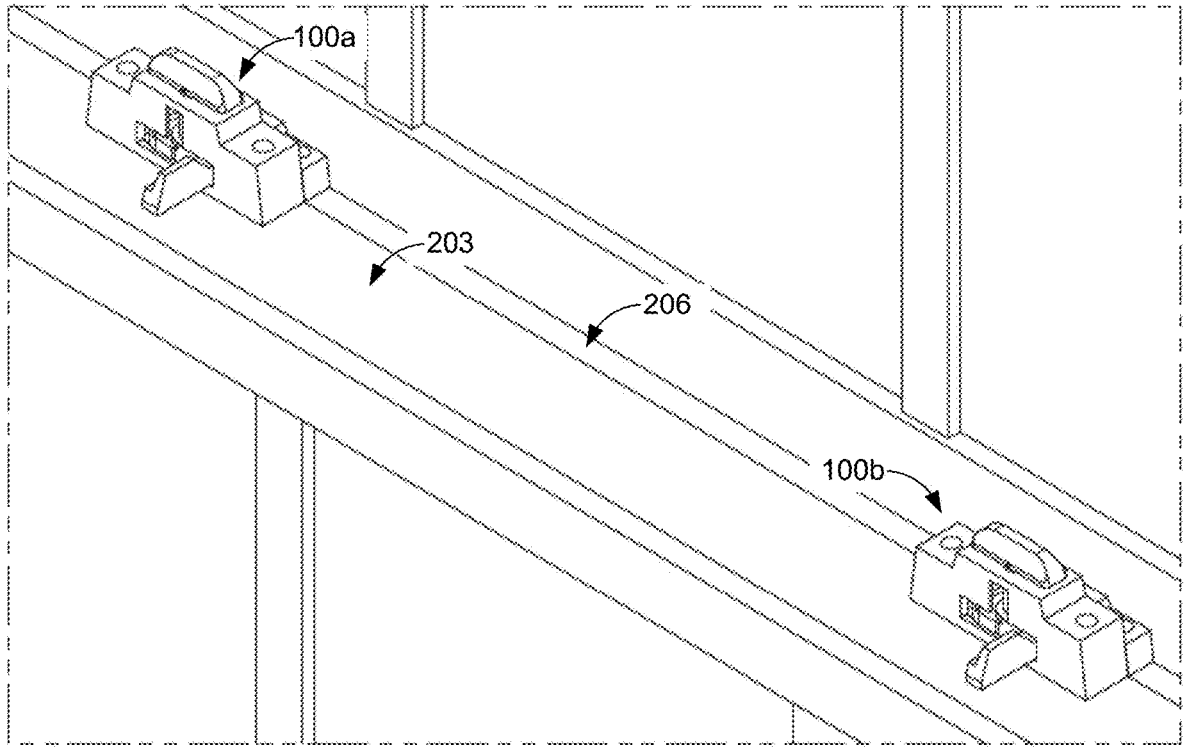
FIG. 19 is an enlarged perspective view of the multiple vertically adjustable sash locks of FIG. 18 installed on a window according to various embodiments of the present disclosure.

Additionally, many times windows are installed that are slightly "racked," meaning the upper sash and the lower sash are not exactly parallel to each other. In this case, an individual may install two or more vertically adjustable sash locks 100*a* . . . 100*b*, as shown in FIG. 18, and adjust each sash lock until the windows better align. An enlarged view of callout region 19 is shown in FIG. 19. Multiple sash locks 100 can assist with side-to-side alignment of the window sashes. This may help with air infiltration on all four sides of the window and give an upper and lower sash of a window a better appearance by being better aligning the upper and lower sash with one another.

Figure 20:
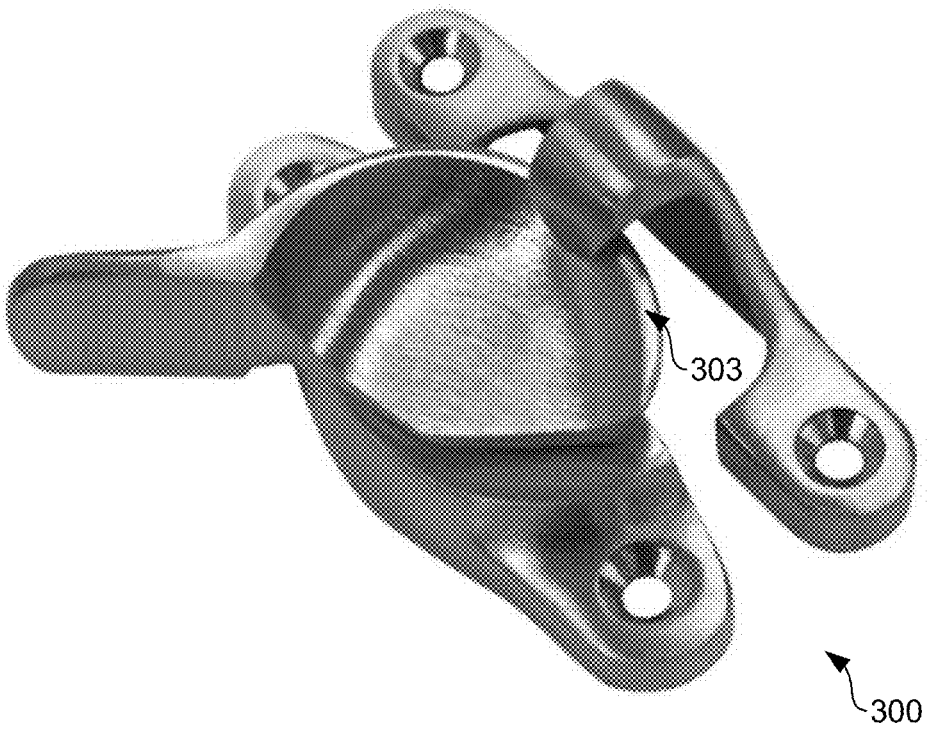
FIG. 20 is an example of a conventional sash lock.

FIG. 20 illustrates an example of an existing sash lock 300, such as the WLS9 Window Sash Lock offered by Deltana®. The existing sash lock 300 includes a rotatable circular-shaped cam having a sloped edge 303. The sloped edge 303 allows the circular cam to engage a keeper bracket when window sashes aren't perfectly level (i.e., when the second window sash drops slightly relative to the first window sash). However, for the circular cam to engage the keeper bracket, the window sashes must be nearly level. For instance, the sloped edge 303 only drops a centimeter or less from the top of the edge. Moreover, the existing sash lock 300 only brings a top rail of the first window sash and the bottom rail of the second window sash to become flush, and does not provide a sufficient degree of separation necessary to form a tight window seal. Notably, when the existing sash lock 300 is locked or fully engaged with its keeper bracket, its vertical position is not adjustable relative to the keeper bracket. As such, in some windows, a person must push the bottom rail of the upper sash 206 downwards so that the keeper bracket can engage with the sash lock 300, or must pull the top rail of the lower sash 203 upwards so that the keeper bracket can engage with the sash lock 300.

Figure 21:
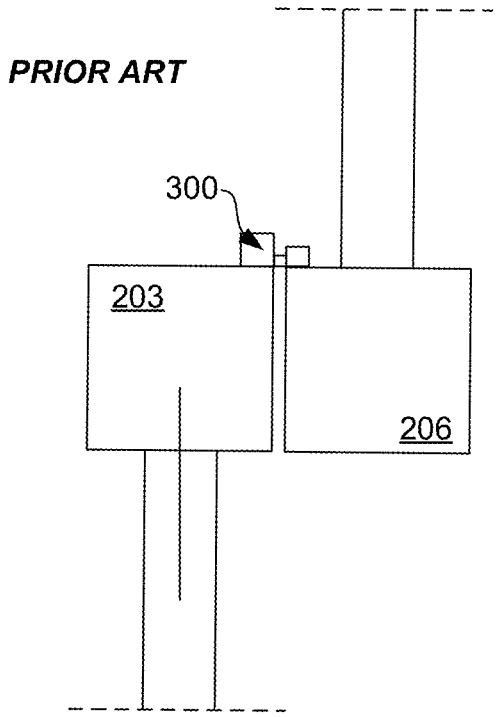
FIG. 21 is an example of a conventional sash lock installed on a first window sash and a second window sash showing the disadvantages of conventional sash locks.

Further disadvantages of existing sash locks 300 are apparent in FIG. 21. Notably, the existing sash lock 300 does not allow for any vertical adjustment between the existing sash lock 300 and its keeper bracket. Further, existing sash locks 300 merely align the top rail of the lower sash 203 with the bottom rail of the upper sash 206, which still permits air, debris, or other content to get through the window 200, as may be appreciated. This is also true of all other currently existing sash locks, as they provide no vertical adjustment beyond the flush position of the top rail of the first sash and the bottom rail of the second sash.

Figure 22A:
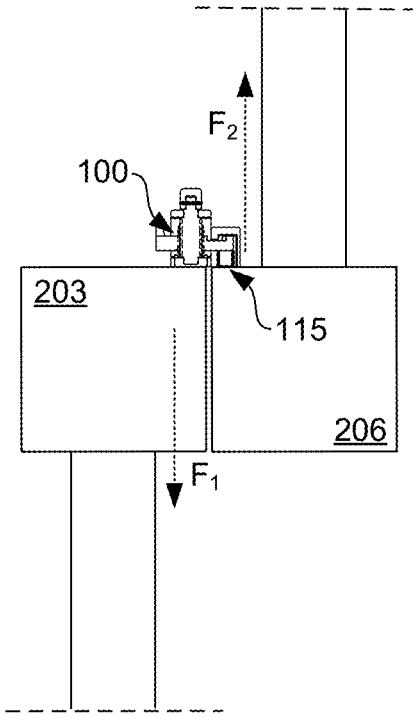
FIGS. 22A and 22B are examples of the vertically adjustable sash lock described herein installed on a top rail of a lower sash and a bottom rail of an upper sash in a window showing the advantages of the various embodiments described herein.
Figure 22B:
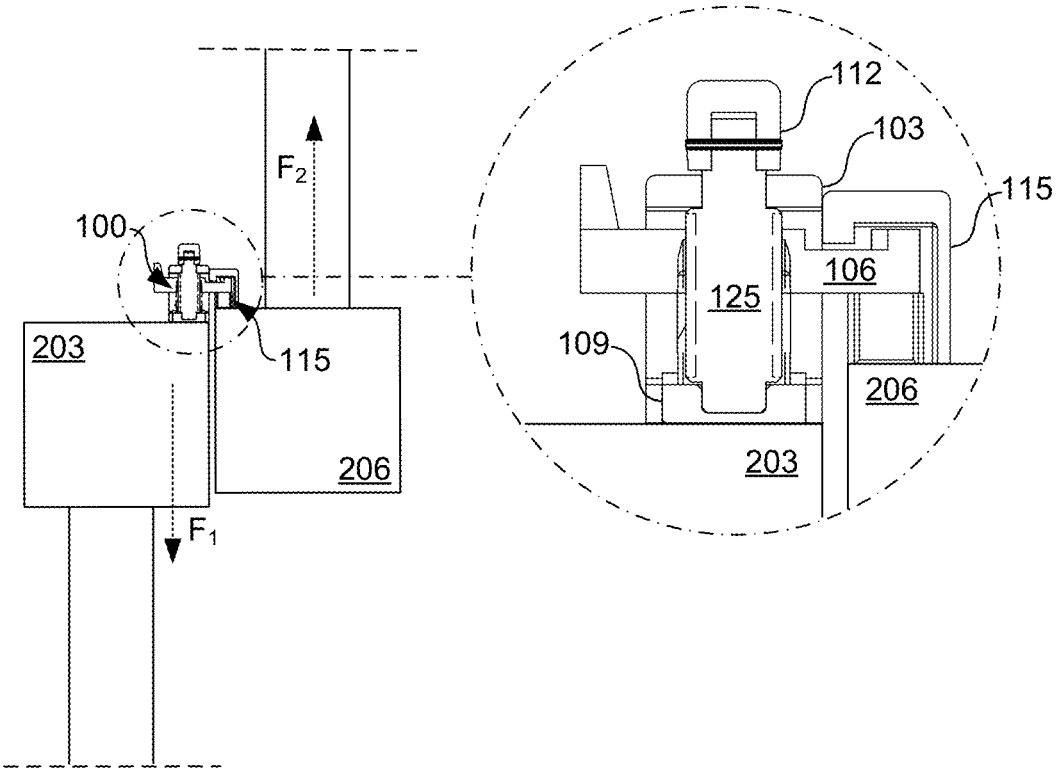

FIGS. 22A and 22B, on the other hand, illustrate a side view of the vertically adjustable sash lock 100 described herein. Notably, the rotatable cam 106 can engage the keeper bracket 115 at different vertical positions, well beyond the capabilities of the sloped edge 303 of existing sash locks 300. For instance, in FIG. 22A, the sash lock 100 and the keeper bracket 115 are shown such that the top rail of the lower sash 203 aligns with the bottom rail of the upper sash 206. As shown in FIG. 22B, the sash lock 100 and the keeper bracket 115 are shown where the cam 106 pulled the keeper bracket 115, and the rail 206 attached thereto, upwards, creating a displacement between the top rail of the lower sash 203 with the bottom rail of the upper sash 206 to create a better seal in the window 200. The position of the cam 106, shown varied between FIGS. 22A and 22B, can be adjusted by the knob 112, which can be rotated to apply an upward force on the keeper bracket 115, driving the top rail of the lower sash 203 downwards (force $F_1$) and driving the bottom rail of the upper sash upwards (force $F_2$). Additionally, a desired degree of separation between the first window sash 203 and the second window sash 206 can be maintained, and adjusted, over time.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

The vertically adjustable sash lock 100 and its various components may be fabricated using various allows such as zinc, aluminum, brass, steel, stainless steel, plastic, or a combination thereof. It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Clause 1. A vertically adjustable sash lock, comprising: a housing configured to be coupled to a first window sash; a rotatable cam partially positioned within the housing configured to rotatably engage with a keeper bracket coupled to a second window sash; a vertical member positioned through a threaded aperture of the rotatable cam; and a knob pivotably coupled to the vertical member, wherein a rotation of the knob causes a change in a vertical position of the rotatable cam along the vertical member relative to a bottom surface of the housing, wherein the rotation of the knob is configured to vertically adjust a height of the housing relative to the keeper bracket engaged with the rotatable cam.

Clause 2. The vertically adjustable sash lock of clause 1, further comprising the keeper bracket, the keeper bracket being configured to be coupled to the second window sash.

Clause 3. The vertically adjustable sash lock of clause 1 or 2, wherein: the knob is positioned on a top surface of the housing; the rotation of the knob in a first direction causes the vertical position of the rotatable cam to increase relative to the bottom surface of the housing; and the rotation of the knob in a second direction causes the vertical position of the rotatable cam to decrease relative to the bottom surface of the housing.

Clause 4. The vertically adjustable sash lock of clause 1, 2, or 3, wherein: the rotatable cam further comprises a lever; and the aperture of the rotatable cam is a threaded aperture, the rotatable cam being threadably coupled to the vertical member through the threaded aperture.

Clause 5. The vertically adjustable sash lock of clause 1, 2, 3, or 4, wherein the housing comprises a base plate, wherein the base plate comprises a recess and a bushing disposed within the recess, wherein the bushing is configured to receive a non-threaded bottom portion of the vertical member and permit a rotation of the vertical member in the base.

Clause 6. The vertically adjustable sash lock of clause 1, 2, 3, 4, or 5, wherein the rotatable cam comprises a channel and an upward projection configured to engage with a downward projection of the keeper bracket.

Clause 7. A sash lock configured to engage with a keeper bracket, wherein the sash lock, when fully engaged with the keeper bracket, has a vertical position that is adjustable relative to the keeper bracket.

Clause 8. The sash lock of clause 7, wherein the sash lock comprises a housing configured to be coupled to a first window sash; and a rotatable cam partially positioned within the housing configured to rotatably engage with the keeper bracket, the keeper bracket being configured to be coupled to a second window sash.

Clause 9. The sash lock of clause 7 or 8, wherein the sash lock further comprises: a vertical member threadably coupled to the rotatable cam through an aperture of the rotatable cam; and a knob coupled to the vertical member, wherein a rotation of the knob drives a rotation of the vertical member causing a change in a vertical position of the rotatable cam along the vertical member relative to a bottom surface of the housing, wherein the rotation of the knob is configured to adjust a height of the housing relative to the keeper bracket when engaged with the rotatable cam.

Clause 10. The sash lock of clause 7, 8, or 9, wherein: the knob is positioned on a top outside surface of the housing; the rotation of the knob in a first direction causes the vertical position of the rotatable cam to increase relative to the bottom surface of the housing; and the rotation of the knob in a second direction causes the vertical position of the rotatable cam to decrease relative to the bottom surface of the housing.

Clause 11. The sash lock of clause 7, 8, 9, or 10, further comprising a base plate configured to be nested within the bottom surface of the housing, wherein the base plate comprises a circular recess configured to receive a non-threaded base of the vertical member and permit a rotation of the vertical member in the circular recess.

Clause 12. The sash lock of clause 7, 8, 9, 10, or 11, further comprising a bushing disposed within the circular recess, the bushing being configured to receive the non-threaded base of the vertical member and facilitate the rotation of the vertical member in the bushing.

Clause 13. The sash lock of clause 7, 8, 9, 10, 11, or 12, wherein the housing comprises: a first channel positioned on a first distal end of the housing for securing the housing to a first window sash; and a second channel positioned on a second distal end of the housing for securing the housing to the first window sash.

Clause 14. The sash lock of clause 7, 8, 9, 10, 11, 12, or 13, wherein the rotatable cam comprises a channel and an upward projection configured to engage with a downward projection of the keeper bracket.

Clause 15. A method, comprising: providing a sash lock having a rotatable cam configured to engage with a keeper bracket, wherein the rotatable cam, when fully engaged with the keeper bracket, has a vertical position that is adjustable relative to the keeper bracket; securing the sash lock to a first window sash; securing the keeper bracket to a second window sash; rotating a knob of the sash lock to adjust a the vertical position of the keeper bracket, causing forces in opposing directions to be applied against the first window sash and the second window sash.

Clause 16. The method of clause 15, wherein the sash lock comprises a housing, the housing being secured to the first window sash by inserting a first screw and a second screw in channels positioned on opposing ends of the housing; and wherein the rotatable cam is partially positioned within the housing and is configured to rotatably engage with the keeper bracket secured to the second window sash.

Clause 17. The method of clause 15 or 16, wherein the sash lock further comprises: a vertical member threadably coupled to the rotatable cam through an aperture of the rotatable cam; and wherein the rotation of the knob drives a rotation of the vertical member causing a change in a vertical position of the rotatable cam along the vertical member relative to a bottom surface of the housing, wherein the rotation of the knob is configured to adjust a height of the housing relative to the keeper bracket when engaged with the rotatable cam.

Clause 18. The method of clause 15, 16, or 17, wherein: the knob is positioned on a top outside surface of the housing; the rotation of the knob in a first direction causes the vertical position of the rotatable cam to increase relative to the bottom surface of the housing; and the rotation of the knob in a second direction causes the vertical position of the rotatable cam to decrease relative to the bottom surface of the housing.

Clause 19. The method of clause 15, 16, 17, or 18, further comprising a base plate configured to be nested within the bottom surface of the housing, wherein the base plate comprises a circular recess.

Clause 20. The method of clause 15, 16, 17, 18 or 19, further comprising a bushing disposed within the circular recess, the bushing being configured to receive a non-threaded base of the vertical member and permit a rotation of the vertical member in the base.

Therefore, the following is claimed:

1. A vertically adjustable sash lock, comprising:

a keeper bracket configured to couple to a bottom rail of an upper window sash;

a housing configured to couple to a top rail of a lower window sash;

a rotatable cam partially positioned within the housing configured to rotatably engage with the keeper bracket, the rotatable cam having a threaded aperture;

a vertical member positioned through the threaded aperture of the rotatable cam;

a knob pivotably coupled to the vertical member, such that a rotation of the knob causes a vertical position of the rotatable cam to change along the vertical member relative to a bottom surface of the housing;

a base plate, wherein a bottom end of the vertical member is positioned at or in a recess of the base plate;

a plurality of coupling channels positioned on opposing ends of a body of the keeper bracket for coupling mechanisms to secure the keeper bracket to the upper window sash via the coupling channels;

wherein the vertically adjustable sash lock is configured such that, when the rotatable cam is coupled to the top rail of the lower window sash and engaged with the keeper bracket, and the keeper bracket is coupled to the bottom rail of the upper window sash, a rotation of the knob causes the rotatable cam to apply a force on the keeper bracket to adjust a relative vertical position of the top rail of the lower window sash and the bottom rail of the upper window sash beyond a flush arrangement, thereby causing the lower window sash to be forced downwards and the upper window sash to be forced upwards.

2. The vertically adjustable sash lock of claim 1, wherein:

the knob is positioned on a top surface of the housing;

the rotation of the knob in a first direction causes the vertical position of the rotatable cam to increase relative to the bottom surface of the housing; and the rotation of the knob in a second direction causes the vertical position of the rotatable cam to decrease relative to the bottom surface of the housing.

3. The vertically adjustable sash lock of claim 2, wherein:

the rotatable cam further comprises a lever; and the rotatable cam is threadably coupled to the vertical member through the threaded aperture.

4. The vertically adjustable sash lock of claim 1, wherein the recess is configured to receive a non-threaded bottom portion of the bottom end of the vertical member and permit a rotation of the vertical member in the base.

5. The vertically adjustable sash lock of claim 1, wherein the rotatable cam comprises a channel and an upward projection configured to engage with a downward projection of the keeper bracket.

6. A sash lock, comprising:

a housing configured to couple to a top rail of a lower window sash;

a rotatable cam partially positioned within the housing, the rotatable cam comprising a threaded aperture and being configured to rotatably engage with a keeper bracket coupled to a bottom rail of an upper window sash;

a vertical member positioned through and threadably coupled to the threaded aperture of the rotatable cam; and a knob pivotably coupled to the vertical member such that a rotation of the knob causes a vertical position of the rotatable cam to change along the vertical member relative to a bottom surface of the housing;

wherein the sash lock is configured such that, when the rotatable cam is coupled to the top rail of the lower window sash and engaged with the keeper bracket, a rotation of the knob causes the rotatable cam to apply a force on the keeper bracket to adjust a relative vertical position of the top rail of the lower window sash and the bottom rail of the upper window sash beyond a flush arrangement, thereby causing the lower window sash to be forced downwards and the upper window sash to be forced upwards.

7. The sash lock of claim 6, wherein:

the knob is positioned on a top outside surface of the housing;

the rotation of the knob in a first direction causes the vertical position of the rotatable cam to increase relative to the bottom surface of the housing; and the rotation of the knob in a second direction causes the vertical position of the rotatable cam to decrease relative to the bottom surface of the housing.

8. The sash lock of claim 7, further comprising a base plate configured to be nested within the bottom surface of the housing, wherein the base plate comprises a circular recess configured to receive a non-threaded base of the vertical member and permit a rotation of the vertical member in the circular recess.

9. The sash lock of claim 8, further comprising a bushing disposed within the circular recess, the bushing being configured to receive the non-threaded base of the vertical member and facilitate the rotation of the vertical member in the bushing.

10. The sash lock of claim 9, wherein the housing comprises:

a first channel positioned on a first distal end of the housing for securing the housing to a first window sash; and a second channel positioned on a second distal end of the housing for securing the housing to the first window sash.

11. The sash lock of claim 10, wherein the rotatable cam comprises a channel and an upward projection configured to engage with a downward projection of the keeper bracket.

12. A method, comprising:

providing a sash lock having a vertical member and a rotatable cam rotatably coupled to the vertical member, the rotatable cam being configured to removably engage with a keeper bracket, wherein the rotatable cam has a vertical position that is adjustable relative to the vertical member and the keeper bracket;

securing the sash lock to top rail of a lower window sash;

securing the keeper bracket to a bottom rail of an upper window sash;

adjusting the rotatable cam such that the rotatable cam of the sash lock is coupled to the keeper bracket; and rotating a knob of the sash lock to adjust a the vertical position of the keeper bracket, such that the rotatable cam applies a force on the keeper bracket that adjusts a relative vertical position of the top rail of the lower window sash and the bottom rail of the upper window sash beyond flush, thereby causing the lower window sash to be forced downwards and the upper window sash to be forced upwards.

13. The method of claim 12, wherein the sash lock comprises a housing, the housing being secured to the top rail of the lower window sash by inserting a first screw and a second screw in channels positioned on opposing ends of the housing; and wherein the rotatable cam is partially positioned within the housing and is configured to rotatably engage with the keeper bracket secured to the bottom rail of the upper window sash.

14. The method of claim 13, wherein the vertical member is threadably coupled to the rotatable cam through a threaded aperture of the rotatable cam.

15. The method of claim 14, wherein:

the knob is positioned on a top outside surface of the housing;

rotating the knob in a first direction causes the vertical position of the rotatable cam to increase relative to the bottom surface of the housing; and rotating the knob in a second direction causes the vertical position of the rotatable cam to decrease relative to the bottom surface of the housing.

16. The method of claim 15, further comprising a base plate configured to be nested within the bottom surface of the housing, wherein the base plate comprises a circular recess.

17. The method of claim 16, further comprising a bushing disposed within the circular recess, the bushing being configured to receive a non-threaded base of the vertical member and permit a rotation of the vertical member in the base.

* * * * *